US005547295A

United States Patent [19]

Kanemitsu

[11] Patent Number: 5,547,295

[45] Date of Patent: Aug. 20, 1996

[54] CARRIAGE DRIVING METHOD AND APPARATUS FOR EFFICIENTLY ACCELERATING TO A CONSTANT SPEED

[75] Inventor: Shinji Kanemitsu, Yokohama, Japan

[73] Assignee: Canon Kabushiki Kaisha, Tokyo, Japan

[21] Appl. No.: 376,096

[22] Filed: Jan. 20, 1995

Related U.S. Application Data

[63] Continuation of Ser. No. 936,772, Aug. 28, 1992, abandoned.

[30] Foreign Application Priority Data

Sep. 2, 1991 [JP] Japan ..... 3-221705

[51] Int. Cl.[6] ..... B41J 21/17

[52] U.S. Cl. ..... 400/279; 400/903; 400/322

[58] Field of Search ..... 400/279, 322, 400/328, 568, 902, 903; 318/696

[56] References Cited

U.S. PATENT DOCUMENTS 4,417,188 11/1983 Makabe et al. ..... 318/696
4,886,808 5/1986 Tanimoto et al. ..... 318/696
5,151,716 9/1992 Kanemitsu ..... 346/140 R

FOREIGN PATENT DOCUMENTS 58-179675 10/1983 Japan ..... B41J 19/18
58-185284 10/1983 Japan ..... B41J 19/18
2145370 6/1990 Japan ..... B41J 19/18

*Primary Examiner*—David A. Wiecking
*Attorney, Agent, or Firm*—Fitzpatrick, Cella, Harper & Scinto

[57] ABSTRACT

A carriage driving motor is driven with acceleration during a time period substantially equal to the half period of periodic vibration generated in a carriage in its moving direction when the carriage shifts from a stopped state to a moving state. Subsequently, the carriage driving motor is driven at a constant speed. Thus, the vibration of the carriage is minimized and movement of the carriage at the constant speed is stabilized.

19 Claims, 7 Drawing Sheets

FIG.4

| PULSE | PULSE WIDTH [m sec] | DRIVING FREQUENCY [pps] |
|---|---|---|
| $T_1$ | 1.700 | 588 |
| $T_2$ | 1.606 | 623 |
| $T_3$ | 1.511 | 662 |
| $T_4$ | 1.417 | 706 |
| $T_5$ | 1.323 | 819 |
| . | . | . |
| . | . | . |
| . | . | . |
| . | . | . |
| $T_n$ | 0.500 | 2000 |
| $T_{n+1}$ | 0.500 | 2000 |
| . | . | . |
| . | . | . |

FIG.6

| PULSE | PULSE WIDTH [m sec] | DRIVING FREQUENCY [pps] |
|---|---|---|
| $T_1'$ | 1.700 | 588 |
| $T_2'$ | 1.511 | 662 |
| $T_3'$ | 1.323 | 756 |
| $T_4'$ | 1.221 | 819 |
| $T_5'$ | 1.119 | 894 |
| ⋮ | ⋮ | ⋮ |
| $Tm'$ | 0.653 | 1531 |
| $Tm'_{+1}$ | 0.639 | 1565 |
| $Tm'_{+2}$ | 0.625 | 1600 |
| $Tm'_{+3}$ | 0.612 | 1634 |
| ⋮ | ⋮ | ⋮ |
| $Tm'_{+3\alpha}$ | 0.612 | 1634 |
| $Tm'_{+4}$ | 0.600 | 1666 |
| ⋮ | ⋮ | ⋮ |
| $Tm'$ | 0.500 | 2000 |
| $Tm'_{+1}$ | 0.500 | 2000 |
| ⋮ | ⋮ | ⋮ |

CARRIAGE DRIVING METHOD AND APPARATUS FOR EFFICIENTLY ACCELERATING TO A CONSTANT SPEED

This application is a continuation of application Ser. No. 07/936,772 filed Aug. 28, 1992, now abandoned.

BACKGROUND OF THE INVENTION

1. Field of the Invention

This invention relates to a carriage driving method for driving a carriage using a motor.

2. Description of the Prior Art

In a conventional carriage driving device, the driving force of a motor is transmitted to a carriage via a belt or a wire to reciprocate the carriage at a constant speed. Such a driving device is used in, for example, a printer device mounting an ink-jet head on a carriage, an original reading device mounting a short-focus image pickup device and an optical sensor on a carriage, or the like. In general, the angular velocity of the motor is changed until the carriage is driven at a constant speed by driving the motor with constant angular acceleration or so that a predetermined constant angular velocity is obtained when the angular acceleration becomes zero while gradually reducing the angular acceleration.

However, in the above-described conventional device, periodic vibration of the carriage in its moving direction is generated when the carriage in a stopped state starts to move, and the carriage is accelerated to a constant speed while being accompanied by the vibration. Hence, the conventional device has the following disadvantages.

That is, although gradually attenuated, the vibration of the carriage is not completely attenuated even if the carriage driving motor is rotating at a constant angular velocity. Accordingly, a long time period is needed until the carriage moves at a constant speed, and therefore a long distance is also needed to attain the constant speed.

A waveform diagram shown in FIG. 8 illustrates the above-described disadvantages in the conventional device. FIG. 8 represents a case in which a carriage is driven by a stepping motor having a step of 0.9° and a pulley having a pitch circle whose circumference is 50 mm (a diameter of 15.915 mm) via a belt, and is accelerated to a constant speed of 250 mm/sec (with a driving frequency of the stepping motor of 2000 pps, 50 mm×2000 pps×0.9°/360°=250 mm/sec). In FIG. 8, the driving frequency of the stepping motor, and the speed of the carriage are represented by a broken line curve a" and a solid-line curve b", respectively, while the ordinate represents the driving speed of the stepping motor and the speed of the carriage, and the abscissa represents time.

As is apparent from FIG. 8, the drive of the stepping motor is suddenly started at least at a certain frequency (400 pps in the present case) depending on the characteristics of the motor. At that time, the carriage abruptly starts to move from the speed 0. Since the curve of the driving frequency of the motor is less steep than the curve of the speed of the carriage as indicated by the broken line, the speed of the carriage "b" exceeds the curve of the driving frequency of the motor at point $b''_1$, where the carriage starts to vibrate.

It can be easily understood that the vibration remains without being completely attenuated at a time period when the speed of the motor reaches the range of a constant speed.

In conventional techniques, in order to promptly attenuate the vibration of the carriage, it is necessary to increase the sliding force between the carriage and the bearing member, or, as disclosed in Japanese Patent Application Public Disclosure (Kokai) No. 58-179675 (1983), to increase resistance by providing the carriage with a sliding force due to another sliding member. However, such sliding resistance has many unstable factors, such as variations in environment of use, or the like, causing variations in the load, which will be a factor causing unevenness in the speed of the carriage.

In order to overcome such problems, two types of carriage driving methods have been proposed in which periodic vibration of a carriage is promptly attenuated without increasing the sliding force, whereby a constant speed can be attained from a stopped state in a short time and in a short distance.

One of such carriage driving methods is disclosed in Japanese Patent Application Public Disclosure (Kokai) No. 58-185284 (1983). In this method, driving pulses having a frequency lower than a rated frequency are supplied to a carriage driving motor from the start of the drive until the value of acceleration is inverted from a positive value to a negative value, and driving pulses with the rated frequency are supplied thereafter.

The other method is disclosed in Japanese Patent Application Public Disclosure (Kokai) No. 2-145370 (1990). In this method, while acceleration of a carriage is reduced from zero to a negative value after the start of the drive and thereafter tends to increase, the driving frequency of the motor is increased at the moment when acceleration is zero.

SUMMARY OF THE INVENTION

It is an object of the present invention to provide a carriage driving method which is more effective than the above-described conventional methods.

It is another object of the present invention to accelerate a carriage driving motor during a time period substantially equal to the half period of periodic vibration generated in a carriage in its moving direction when the carriage moves from a stopped state to a moving state, and thereafter to shift the carriage driving motor to constant-speed drive.

According to a first aspect of the present invention, a recording device, for recording while scanning a recording head, includes a carriage, a stepping motor, a driving circuit, and control means. The carriage is for mounting the recording head and has a natural frequency. At the natural frequency, a periodic vibration of the carriage occurs when accelerated. The stepping motor is for moving the carriage. The driving circuit is for switching respective phases of the stepping motor in accordance with an input pulse signal, and sequentially advancing the respective phases. The control means generates the pulse signal for determining a driving frequency for the stepping motor in order to drive a carriage. The control means applies the generated signal to the driving circuit so as to drive the stepping motor with acceleration during a time period substantially equal to a half period of the periodic vibration generated in the carriage in a moving direction when a carriage shifts from a stopped state to a moving state, and thereafter drives the stepping motor at a constant speed.

According to another aspect of the present invention, a carriage driving method for driving a carriage from a stopped state to a constant speed moving state includes the steps of driving a stepping motor for driving the carriage with acceleration during a time period substantially equal to a half period of periodic vibration generated in the carriage in a moving direction when the carriage shifts from a stopped state to a moving state, and driving the stepping motor at a constant speed after completion of the drive of the stepping motor with accelaration.

According to yet a further aspect of the present invention, the carriage driving method includes the steps of driving the stepping motor for driving a carriage with acceleration during a time period substantially equal to a half period of periodic vibration generated in the carriage, driving the stepping motor at a constant speed during the time period of driving the stepping motor with acceleration, and driving the sepping motor at a constant speed after completion of the drive of the stepping motor with acceleration.

These and other objects, advantages and features of the present invention will become more apparent from the following description of the preferred embodiments taken in connection with the accompanying drawings.

BRIEF DESCRIPTION OF THE DRAWINGS

FIG. 4 is a diagram showing a table provided within the pulse oscillation circuit shown in FIG. 2;

FIG. 6 is a diagram showing another table provided within the pulse oscillation circuit shown in FIG. 2;

DESCRIPTION OF THE PREFERRED EMBODIMENTS

Embodiments of the present invention will now be explained in detail with reference to the drawings.

Figure 1:
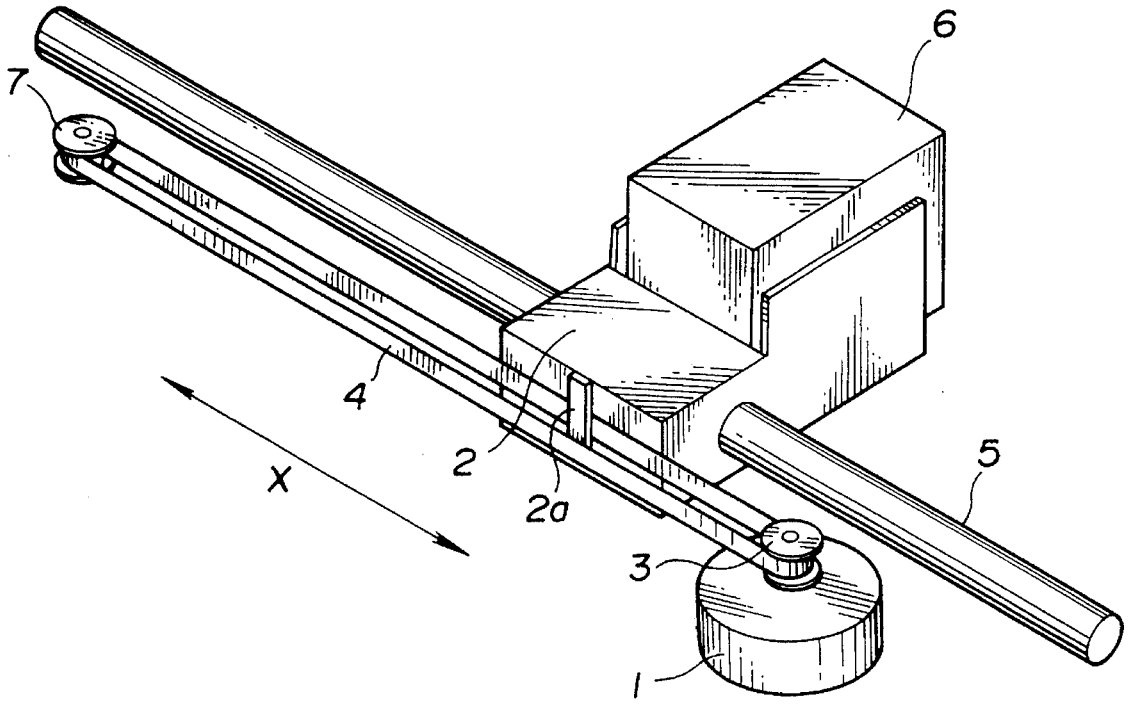
FIG. 1 is a perspective view of a carriage driving device according to an embodiment of the present invention.

FIG. 1 is a diagram showing a carriage driving device according an embodiment of the present invention, and illustrates a recording device in which a recording head 6 for recording characters or images by discharging liquid drops from a discharging element using thermal energy is mounted on a carriage 2.

The carriage 2 is fixed to driving belt 4 mounted between a motor pulley 3 provided on a stepping motor 1 for driving, and an idler pulley 7 by a fixing unit 2*a*, and performs reciprocating movement in the X direction along a guide rail 5 by the drive of the stepping motor 1. With that movement, the recording head 6 mounted on the carriage 2 performs recording.

Figure 2:
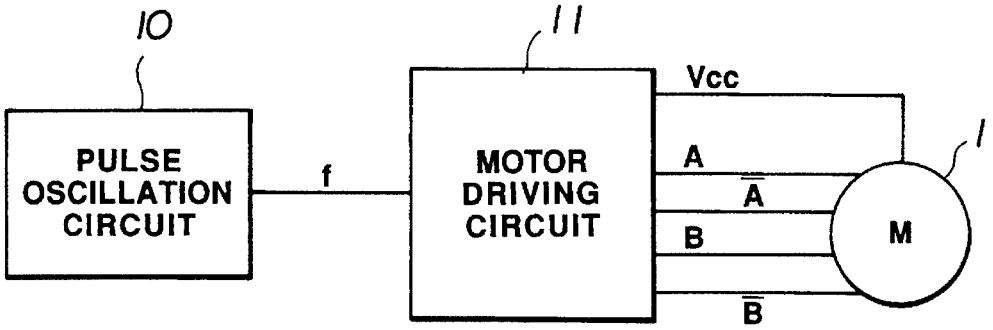
FIG. 2 is a diagram showing the configuration of a driving circuit for the stepping motor shown in FIG. 1.
Figure 3:
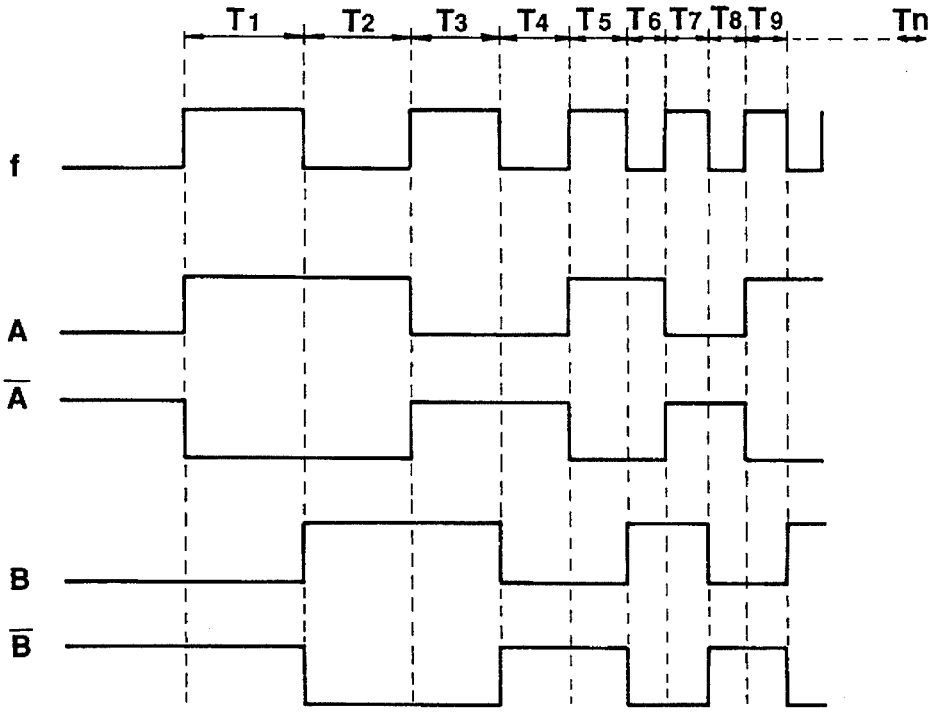
FIG. 3 is a diagram showing phase switching of the stepping motor shown in FIG. 2.

FIG. 2 is a diagram showing the configuration of a driving circuit for the stepping motor 1 shown in FIG. 1. FIG. 3 is a diagram showing phase switching of the stepping motor 1 by pulses.

In FIG. 2, a pulse oscillation circuit 10 generates a pulse signal (f) for determining the driving frequency for the stepping motor 1 which drives the carriage 2 (an object to be moved at a constant speed). A motor driving circuit 11 sequentially advances respective phase patterns (A, inversed-A, B and inversed-B signals) of the stepping motor 1 in accordance with the pulse signal (f). Respective phases are switched by the pulse signal (f) as shown in FIG. 3. The pulse oscillation circuit 10 includes, for example, a table as shown in FIG. 4, and sequentially outputs pulses having the corresponding pulse widths beginning with pulse $T_1$, and performs accelerating driving until pulse $T_n$. After pulse $T_n$, the pulse oscillation circuit 10 performs a constant-speed driving with pulses having the same pulse width.

Figure 5:
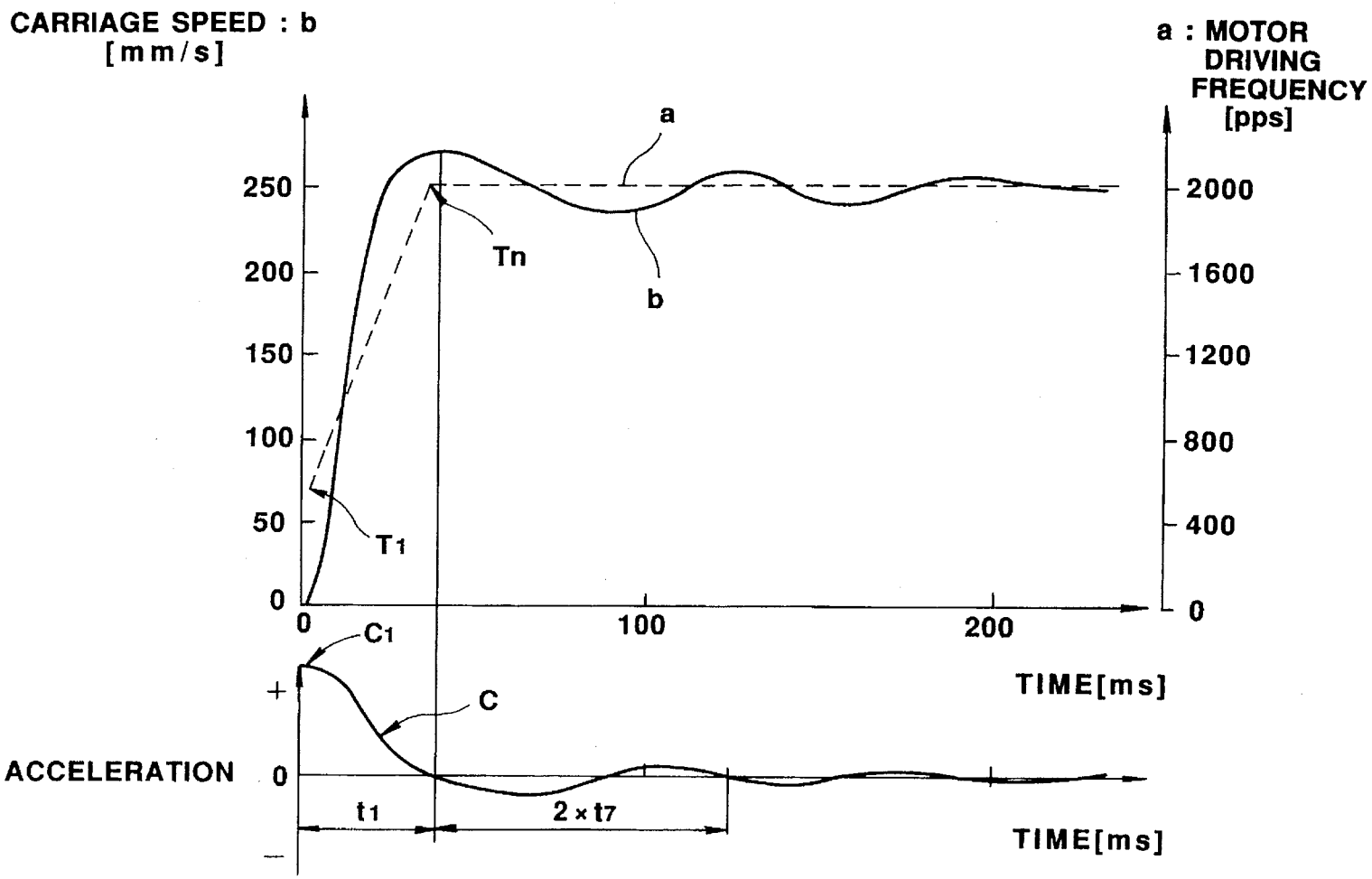
FIG. 5 is a diagram showing a change in the speed of a carriage when the motor is driven using the table shown in FIG. 4.

FIG. 5 shows the relationship between the elapsed time and the motor driving frequency when the pulse motor 1 is driven using the table shown in FIG. 4 with a broken line "a", and shows the relationship between time and the carriage speed of the carriage 2 driven by the stepping motor 1 with a solid line b. Acceleration of the carriage at that time is shown with a solid line c.

From FIG. 5, it can be understood that the time from pulse $T_1$ to pulse $T_n$, in which the stepping motor is accelerated, is set so as to substantially coincide with time $t_1$, in which the acceleration of the carriage abruptly increases from 0 to $C_1$ and returns to 0, and the value of time $t_1$ corresponds to ½ the duration of one period of natural vibration generated by the carriage. The carriage abruptly starts to move from the speed 0 by the driving force of the stepping motor. The speed of the carriage is lower than the speed of the stepping motor until the carriage reaches a speed of about 120 mm/sec, when an overshoot having a speed higher than the driving speed occurs due to the vibration of the carriage. The point of inflection of the speed is produced at a time period equal to the half period of the vibration during time $t_1$. If the state of the vibration in the constant-speed range is considered, in order to reduce the influence due to the vibration as early and as small as possible, it is necessary to reduce the amplitude of the vibration of the carriage when the speed reaches the constant-speed range.

In consideration of the above-described requirement, in the driving method of the present invention, by performing acceleration toward time $t_1$ equal to the half period of the vibration of the carriage, the overshoot of the carriage speed is minimized at time $t_1$ corresponding to the point of inflection of the carriage speed. As a result, the amplitude of the vibration of the carriage at the constant-speed range is minimized.

An explanation will now be provided of a driving method for reducing the overshoot when the carriage speed reaches the constant-speed range.

Figure 7:
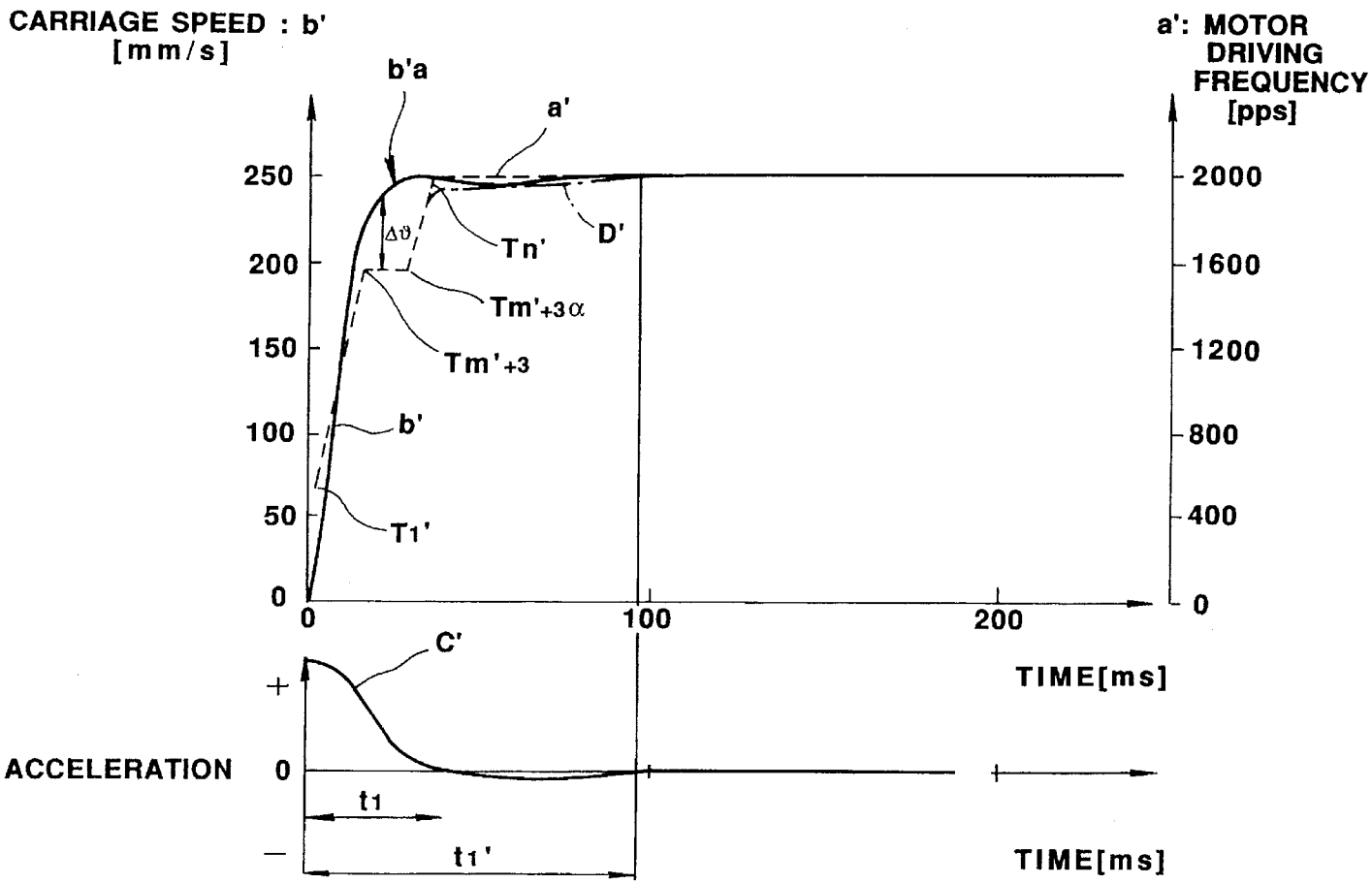
FIG. 7 is a diagram showing a change in the speed of the carriage when the motor is driven using the table shown in FIG. 6.

FIG. 6 shows a table used, for example, by the pulse oscillation circuit 10, which is similar to the table shown in FIG. 4. FIG. 7 is a diagram showing the relationship between the elapsed time, and the driving frequency a' for the stepping motor, the carriage speed b' and the acceleration c' of the carriage when the stepping motor is driven using the table shown in FIG. 6.

Figure 8:
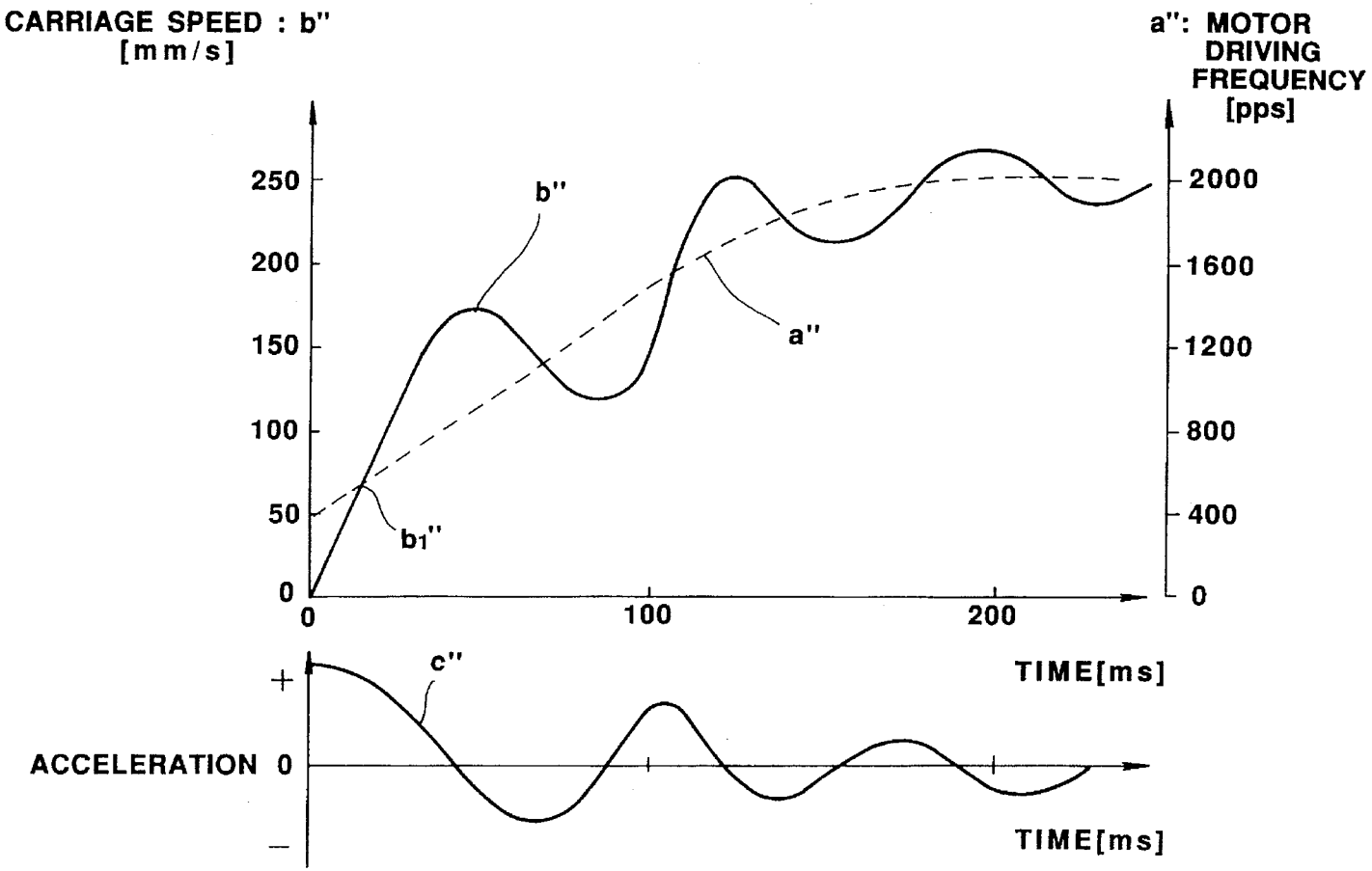
FIG. 8 is a diagram showing a change in the speed of the carriage in the prior art.

As is apparent from FIGS. 8 and 7, while time $t_1$ until the carriage speed reaches the constant-speed range is the same as that shown in FIG. 5, a constant-speed region $T_{m'+3}-T_{m'+3\propto}$ is provided within an acceleration range $T_{1'}-T_{n'}$. The carriage speed b' produces an overshoot of the speed in the same manner as described above. However, since the amount Δv of the overshoot abruptly increases when the carriage speed reaches the constant-speed region $T_{m'+3}-T_{m'+3\propto}$, of the stepping motor, the absolute speed of the carriage is flattened near point $b'_a$ before time $t_1$. Accordingly, by setting the constant-speed region $T_{m'3}-T_{m'+3\propto}$, it is possible to adjust the flattened carriage speed to the constant speed 250 mm/sec. By accelerating again the carriage from $T_{m'+3\propto}$ to $T_{n'}$, and setting the carriage speed to the constant speed at time $t_1$, it is possible to provide a state in which there is no difference between the carriage speed and the driving speed, that is, the amplitude of the vibration of the carriage in the constant-speed range is substantially 0, within a very short time period from the start of the movement of the carriage. The values of $T_{m'+3}-T_{m'+3}\propto$ corresponding to the constant-speed region in the present driving method cannot be determined as constants, since these values are influenced by a difference in the mass (the natural frequency) of the carriage, or the like. However, these values can always be provided within the acceleration range, provided that the acceleration range is set to be substantially equal to the half period of the vibration of the carriage.

Although in the above-described embodiment, the carriage is accelerated until time $t_1$, which is substantially equal to the half period of the vibration, the same effects may be obtained even if the acceleration is reduced immediately before the shift to the constant-speed range and the carriage speed enters the constant-speed range at time $t_{1'}$, as indicated by the curve of the motor driving frequency represented by the chain line D' shown in FIG. 7. Hence, such an approach does not deviate from the spirit and scope of the present invention of providing an acceleration range substantially equal to the half period of the vibration of the carriage.

As described above in detail, according to the present invention, the acceleration driving range of the motor for driving the carriage is set to a time substantially equal to the half period of the vibration generated in the moving direction of the carriage, and thereafter the driving speed of the carriage driving motor is shifted to the constant-speed range. It is thereby possible to minimize the vibration of the carriage, and to stabilize the speed in the constant-speed range.

The individual components shown in outline or designated by blocks in the drawings are all well known in the image recording and motor driving arts and their specific constructiion and operation are not critical to the operation or best mode for carrying out the invention.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording device for recording while scanning a recording head, said device comprising:

a carriage for mounting said recording head, said carriage having a natural frequency, wherein a periodic vibration equal to the natural frequency of said carriage occurs when accelerated;

a stepping motor for moving said carriage;

a driving circuit for switching respective phases of said stepping motor in accordance with an input pulse signal, and sequentially advancing the respective phases; and control means for generating the pulse signal for determining a driving frequency for said stepping motor in order to drive said carriage, said control means comprising setting means for setting a time period of nearly a half period of the periodic vibration generated in said carriage in a moving direction when said carriage shifts from a stopped state to a moving state equal to a time for an acceleration region of said stepping motor, and driving said stepping motor with acceleration during the time period, and thereafter generating the pulse signal so as to drive said stepping motor at the constant speed as said stepping motor being in a constant speed region.

2. A device according to claim 1, wherein said recording head comprises an ink-jet recording head.

3. A device according to claim 1, wherein said setting means comprises a table, said table being set so as to make the time period of nearly the half period of periodic vibration generated in said carriage in the moving direction when said carriage shifts from the stopped state to the moving state substantially equal to the time of the acceleration region of said stepping motor and drive said stepping motor with acceleration during the time period, and thereafter causing said control means to generate the pulse signal so as to drive said stepping motor at the constant speed as said stepping motor being in the constant speed region.

4. A device according to claim 1, wherein a width of the pulse signal decreases during the time period of acceleration.

5. A device according to claim 4, wherein the width of the pulse signal remains constant when the stepping motor is driven at a constant speed.

6. A device according to claim 1, wherein a width of the pulse signal decreases during the time period of acceleration.

7. A device according to claim 1, wherein said setting means comprises a table, said table being set so as to make the time period of nearly a half period of the periodic vibration generated in said carriage in the moving direction when said carriage shifts from the stopped state to the moving state substantially equal to the time of the acceleration region of said stepping motor and cause said control means to generate the pulse signal so as to drive said stepping motor with acceleration during the time period, and further, set to have a portion to drive said stepping motor at a constant speed within the acceleration region of said stepping motor.

8. A carriage driving method for driving a carriage from a stopped state to a constant-speed moving state, said method comprising the steps of:

driving a stepping motor for driving the carriage with acceleration with a time period of nearly a half period of periodic vibration generated in the carriage in a moving direction when the carriage shifts from a stopped state to a moving state being a time of an acceleration region of the stepping motor;

driving the stepping motor at a constant speed during a portion of the acceleration region of the stepping motor; and driving the stepping motor at a constant speed after completion of driving the stepping motor with acceleration.

9. A driving method according to claim 8, wherein in said step of driving the stepping motor with acceleration, pulse signals are applied with a successively decreasing width.

10. A driving method according to claim 8, wherein in said steps of driving the motor at a constant speed, pulse signals are applied with a constant width.

11. A carriage driving device comprising:

a carriage having a natural frequency, wherein a periodic vibration equal to the natural frequency of said carriage occurs when accelerated;

a stepping motor for moving said carriage;

a driving circuit for switching respective phases of said stepping motor in accordance with an input pulse signal, and sequentially advancing the respective phases; and control means for generating the pulse signal for determining a driving frequency for said stepping motor in order to drive said carriage, said control means driving said stepping motor with acceleration with a time period of nearly a half period of the periodic vibration generated in said carriage in a moving direction when said carriage shifts from a stopped state to a moving state being the time of an acceleration region of said stepping motor, and thereafter generating the pulse signal so as to drive said stepping motor at a constant speed as said stepping motor being in a constant speed region and providing the pulse signal to said driving circuit.

12. A device according to claim 11, wherein said control means includes a table, said table being set so as to make the time period of nearly the half period of periodic vibration generated in said carriage in the moving direction when said carriage shifts from the stopped state to the moving state substantially equal to the time of the acceleration region of said stepping motor and drive said stepping motor with acceleration during the time period, and thereafter causing said control means to generate the pulse signal so as to drive said stepping motor at the constant speed as said stepping motor being in a constant speed region.

13. A device according to claim 11, wherein a width of the pulse signal decreases during the time period of acceleration.

14. A device according to claim 13, wherein the width of the pulse signal remains constant when the stepping motor is driven at a constant speed.

15. A device according to claim 11, wherein a width of the pulse signal decreases during the time period of acceleration.

16. A device according to claim 11, wherein said control means comprises a table, said table being set to make said control means generate the pulse signal so as to make the time period of nearly a half period of the periodic vibration generated in said carriage in the moving direction when said carriage shifts from the stopped state to the moving state substantially equal to the time of the acceleration region of said stepping motor and drive said stepping motor with acceleration, and further, to have a portion to drive said stepping motor at a constant speed within the acceleration region of said stepping motor.

17. A carriage driving method for driving a carriage from a stopped state to a constant-speed moving state, said method comprising the steps of:

driving a stepping motor for driving the carriage with acceleration by making a time period of nearly a half period of periodic vibration generated in the carriage in a moving direction when the carriage shifts from a stopped state to a moving state substantially equal to the time of an acceleration region of the stepping motor; and driving the stepping motor at a constant speed after the completion of the drive of the stepping motor with acceleration.

18. A driving method according to claim 17, wherein in said step of driving the stepping motor with acceleration, pulse signals are applied with a successively decreasing width.

19. A driving method according to claim 17, wherein in said step of driving the motor at a constant speed, pulse signals are applied with a constant width.

* * * * *

UNITED STATES PATENT AND TRADEMARK OFFICE

CERTIFICATE OF CORRECTION

PATENT NO. : 5,547,295

DATED : August 20, 1996

INVENTOR(S) : Shinji KANEMITSU

It is certified that error appears in the above-indentified patent and that said Letters Patent is hereby corrected as shown below:

Title page:

At item [56] References Cited:

Under "U.S. PATENT DOCUMENTS"

"4,886,808 5/1986 Tanimoto et al." should read --4,586,808 5/1986 Tanimoto et al.--;

Under "FOREIGN PATENT DOCUMENTS"

"2145370 6/1990 Japan" should read --2-145370 6/1990 Japan--.

Signed and Sealed this

Fourteenth Day of January, 1997

Bruce Lehman

*Attest:*

BRUCE LEHMAN

*Attesting Officer*

*Commissioner of Patents and Trademarks*